US006619180B1

(12) United States Patent
Hoover et al.

(10) Patent No.: US 6,619,180 B1
(45) Date of Patent: Sep. 16, 2003

(54) TRI-BAR ARMOR AND SIGNATURE REDUCTION DESIGN

(75) Inventors: Chris Hoover, Santa Clara, CA (US); Marco Alberto Middione, Scotts Valley, CA (US)

(73) Assignee: United Defense LP, Arlington, VA (US)

( * ) Notice: Subject to any disclaimer, the term of this patent is extended or adjusted under 35 U.S.C. 154(b) by 0 days.

(21) Appl. No.: 10/280,544

(22) Filed: Oct. 24, 2002

(51) Int. Cl.[7] ..... F41H 5/02
(52) U.S. Cl. ..... 89/36.02
(58) Field of Search ..... 89/36.01, 36.02, 89/36.03

(56) References Cited

U.S. PATENT DOCUMENTS 3,478,643 A * 11/1969 Forsyth et al. ..... 89/36.08
4,021,946 A * 5/1977 Bradshaw ..... 40/473
4,156,033 A * 5/1979 Bienz ..... 427/8
4,638,580 A * 1/1987 Giannetti et al. ..... 40/503
5,255,465 A * 10/1993 Perez ..... 40/505
5,499,568 A * 3/1996 Turner ..... 89/36.08
5,576,508 A * 11/1996 Korpi ..... 89/36.01
5,734,495 A * 3/1998 Friedman ..... 359/350
5,760,327 A * 6/1998 Alexander ..... 89/1.11
5,792,974 A * 8/1998 Daqis et al. ..... 89/36.02
6,128,841 A * 10/2000 Werner ..... 40/505
6,338,292 B1 * 1/2002 Reynolds et al. ..... 89/36.02

FOREIGN PATENT DOCUMENTS

WO WO 9119950 * 12/1991

* cited by examiner

*Primary Examiner*—Charles T. Jordan
*Assistant Examiner*—Jordan M Lofdahl
(74) *Attorney, Agent, or Firm*—Keith Kline Law Firm

(57) ABSTRACT

A weight efficient spaced armor system that utilizes three-sided armor elements also includes a method of adaptive concealment to provide a reduced detection signature for combat vehicles, ships, or other military structures. The tri-bar elements are rotated to three positions, each of the three positions exposing a different outer surface so that three different signature management treatments can be exposed. The structure of the tri-bar elements provides an inherent standoff from the hull, thereby increasing the armor effectiveness.

7 Claims, 2 Drawing Sheets

TRI-BAR ARMOR AND SIGNATURE REDUCTION DESIGN

BACKGROUND OF THE INVENTION

1. Field of the Invention

The present invention relates generally to armor systems, and more particularly is a tri-bar armor system that incorporates signature reduction measures.

2. Description of the Prior Art

Combat vehicles and other military equipment require the ability to survive enemy threats. Common known enemy threats include ballistic and other missile attacks that can easily destroy a piece of equipment. The need to survive such threats gives rise to two competing requirements—the necessity of armor protection balanced against the desire for a reduced detection signature for the equipment.

Combat vehicle platforms require armor protection against common ballistic threats such as 7.62 mm, 12.7 mm, and 14.5 mm weapons that can be fired by soldiers on foot. Normal armor materials such as rolled homogeneous armor (RHA) and aluminum armor are too heavy for rapid deployment operations. An armor system used in rapid deployment situations must be lightweight and still provide effective protection. However, in order to minimize the possibility of detection, combat vehicles also require signature management. A combat vehicle with an effectively reduced signature makes detection, classification, engagement, and destruction by enemy missile systems far more difficult. Signature management materials have limited durability and require careful integration to perform successfully. Therefore, signature management materials require a durable, robust support structure to ensure a long product life and reliable performance.

These two requirements—armor protection and signature management—both compete for the outermost surface of combat vehicles and structures. In order to minimize weight and volume and to integrate ballistic and signature management requirements, a synergistic combination of the two competing interests is desired.

Military prior art solutions for signature reduction include color paint schemes and infrared (IR) coatings that allow the vehicle or other structure to blend into the surrounding background. If the combat vehicle does not match the background well, the addition of branches, leaves, and dirt to the combat vehicle is used to provide adaptive camouflage. In some cases, mud is smeared over the vehicle to allow the vehicle to blend into the surrounding landscape. In situations where mud is not readily available, motor oil or grease may be smeared over the outer vehicle surface of the vehicle or structure, and local dry soil applied over the oil or grease.

Military prior art also includes camouflage paint schemes such as desert tan and forest or woodland patterns, as well as nets or covers that attach to the vehicle or structure to be camouflaged. Camouflage nets are not practical for a moving combat vehicle, as the nets are easily damaged and may limit the functionality of the vehicle by restricting access through hatches and limiting rotation of the turret. Camouflage covers that attach with various fasteners are also not very durable, and they can provide only one camouflage color or pattern.

There is an even larger body of military prior art technology related to armor systems. Recent developments in the field include ceramic composite armor systems, perforated armor systems, and fixed-position bar armor systems.

Accordingly, it is an object of the present invention to provide an armor system that protects a vehicle or other structure from missile attack.

It is a further object of the present invention to provide an armor system that gives the vehicle or other structure on which it is deployed a reduced detection signature.

It is a still further object of the present invention to provide an armor system that is weight efficient, but that provides a robust and durable basis for a signature reduction program.

SUMMARY OF THE INVENTION

The present invention is a weight efficient spaced armor system utilizing tri-bar armor elements. The armor system includes a method of adaptive concealment to provide a reduced detection signature for combat vehicles, ships, or other military structures. One key characteristic of the tri-bar armor system of the present invention is that it incorporates high strength armor materials (i.e. high strength steel, titanium, ceramic faced armor, or other advanced armor material) into a tri-bar tube that is rotated to three positions, each of the three positions exposing a different outer surface. This characteristic allows three different signature management treatments to be applied to the platform. Each of the three surfaces of the tri-bar elements may be painted with a unique camouflage pattern and color scheme that provides the combat vehicle commander the flexibility to adapt to varying environmental conditions.

Additionally, advanced signature materials for thermal, radar, or other spectra may be selectively applied to one or more of the surfaces. The advanced signature materials can be hidden and protected from normal view while moving into a combat operation, and then exposed by the combat vehicle commander as required to maintain effective concealment during an assault that engages the enemy. A combat vehicle can thus be transported into battle while only exposing a simple painted camouflage scheme, so that the enemy is unaware of the presence of other applied signature reduction technologies. When it is advantageous to do so, the commander rotates a given advanced signature management treatment to an exposed outer position that is viewable by the enemy sensors and optics. Delaying as long as possible the disclosure of the particular signature reduction technology to be utilized greatly improves the ability of the technology to conceal the platform.

The armor performance of the tri-bar system is identical in all three of the rotational positions, that is, the application of the signature management technology to an outer surface does not in any way affect the mass or strength of the underlying armor. Moreover, the inherent robustness and durability of the armor provides a superior base structure for any paint or other signature management material that is to be applied to the armor.

An advantage of the present invention is that the tri-bar elements can be rotated to present three separate and distinct outer surfaces for signature management.

Another advantage of the present invention is that the geometry of the tri-bar elements provides a natural standoff spacing for the armor system.

A still further advantage of the present invention is that the tri-bar armor elements provide an excellent base for the application of signature management coating or treatment materials.

These and other objects and advantages of the present invention will become apparent to those skilled in the art in view of the description of the best presently known mode of carrying out the invention as described herein and as illustrated in the drawings.

DETAILED DESCRIPTION OF THE INVENTION

Figure 1:
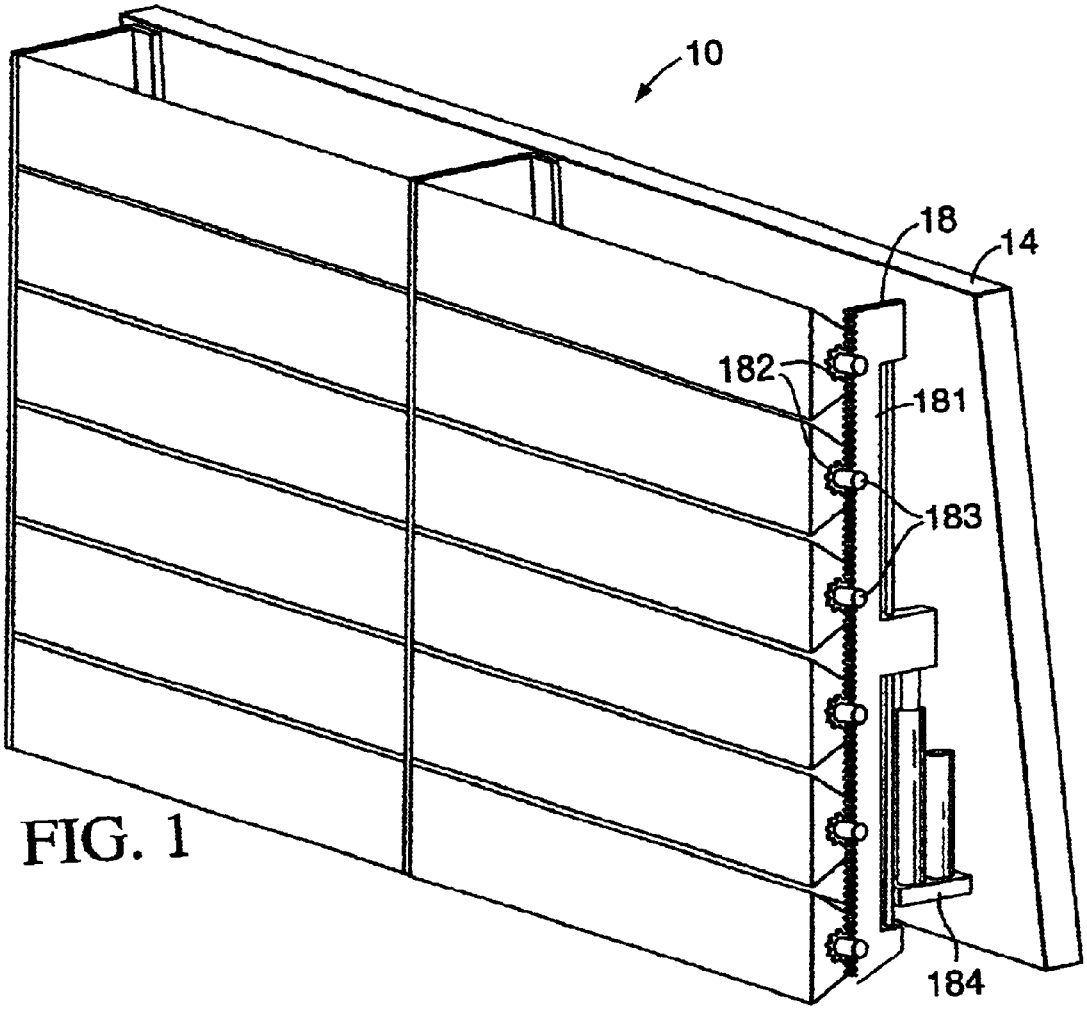
FIG. 1 is a perspective view of a mechanized tri-bar armored platform according to the present invention.

The present invention is a spaced armor platform system 10 utilizing tri-bar armor elements 12. The three-sided tri-bar elements 12 are made of any of a variety of armor materials, including but not limited to titanium, high strength steel, ceramic-faced composite, and other ballistic defense materials. While the present invention utilizes bars with three sides, it should be clear that any number of sides could be utilized on a rotating armor element while still embodying the teaching of the present invention. The tri-bar elements 12 provide equal ballistic protection in each of three rotated positions. (The rotation mechanism will be explained in some detail below.)

The armor system platforms 10 formed from the tri-bar elements 12 comprise a spaced armor structure on the outside of a combat vehicle's hull 14, or on a wall of a stationary structure. The performance of the armor system 10 is enhanced by the synergistic combination of the spaced triangular tri-bar elements 12 tubes with an inherent standoff from the hull structure 14. The tri-bar elements 12 cause fracture, tipping, and rotation of an incoming projectile. The hull structure 14 catches the broken debris from the deflected incoming projectile. The hull 14 material is typically made from aluminum, titanium, steel, ceramic composite, or other armor materials.

The armor platform system 10 further comprises a method of adaptive concealment to provide a reduced detection signature. Each of the tri-bar elements 12 comprise an outer signature management layer 16. (See FIGS. 3 and 4.) The tri-bar elements 12 are rotated so that any one of the three surfaces of the signature management layer 16 can be selected to form the visible outer surface of the armor system 10. This capability allows up to three different signature management treatments, or any combination of the treatments, to be used to camouflage the armor system 10, which provides the combat vehicle commander (or base commander, etc.) the flexibility to adapt to varying environmental conditions and enemy threats. For example, a military vehicle utilizing the armor system 10 of the present invention could have the three surfaces of the tri-bar elements 12 painted in woodland, winter, and desert camouflage schemes respectively. Thus, depending on a given location of the vehicle, the vehicle could display any one of the three camouflage schemes painted on the tri-bar elements 12. Additionally, advanced signature reduction materials adapted for reducing thermal, radar, or other spectra signatures may be selectively applied to one or more of the surfaces of the tri-bar elements 12. Using different paint schemes and advanced signature reduction materials, a first surface of the tri-bar elements 12 could be tuned for best visual matching, a second surface tuned for best radar absorbing properties, and a third for best thermal reduction properties. By reducing the vehicle's (or structure's) signature, the survivability is greatly enhanced. Further tuning of the signature may be obtained by biasing the tri-bar elements 12 up to brighten the paint color (increased solar gain) or biasing the them down to darken the surface (less solar gain).

The tri-bar elements 12 are strong, durable ballistic materials that can withstand military combat vehicle operations. The camouflage paint schemes or advanced signature reduction material on the signature management layer 16 of the tri-bar elements 12 are thus highly durable and rugged due to their application onto an armor base surface.

Figure 2:
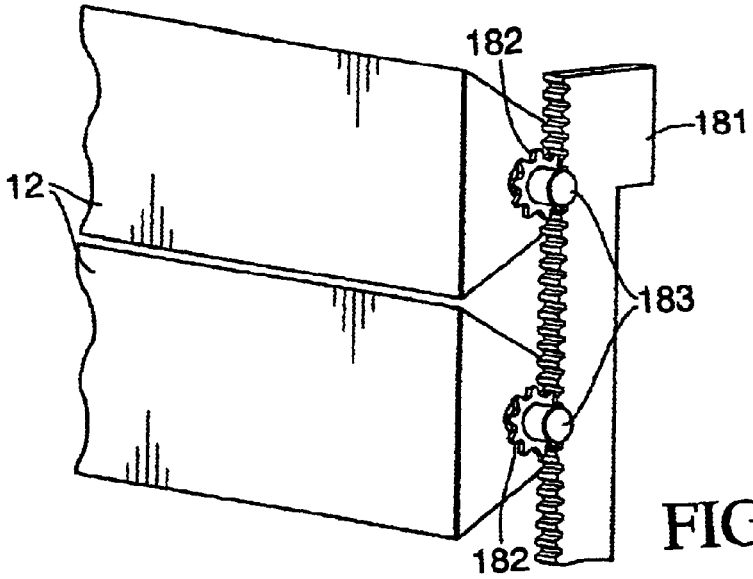
FIG. 2 is a detail view of the drive mechanism linked to a pair of the tri-bar elements.
Figure 3:
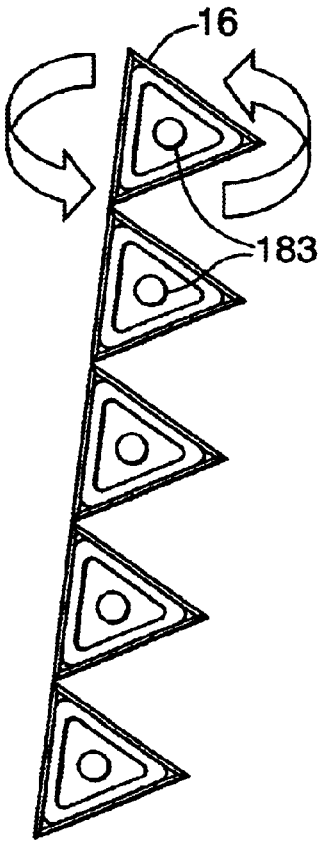
FIG. 3 is a side view of a mechanized tri-bar armored platform indicating the axis of rotation of the tri-bar elements.

Referring now chiefly to FIGS. 1–3, in one preferred embodiment, the tri-bar elements 12 are automatically rotated by a mechanized drive means 18. While it is clear to those skilled in the art that any mechanized drive means that applies rotational motion to the tri-bar elements 12 could be used, in the preferred embodiment, a rack 181 and pinion 182 arrangement is utilized. Each of the tri-bar elements 12 is built with a central shaft 183. Pinion gears 182 are mounted on an exterior end of the shaft 183. A double action hydraulic cylinder 184 provides the motive force for the rack 181. As the rack 181 is driven up and down, the tri-bar elements 12 rotate to expose the desired surface.

Figure 4:
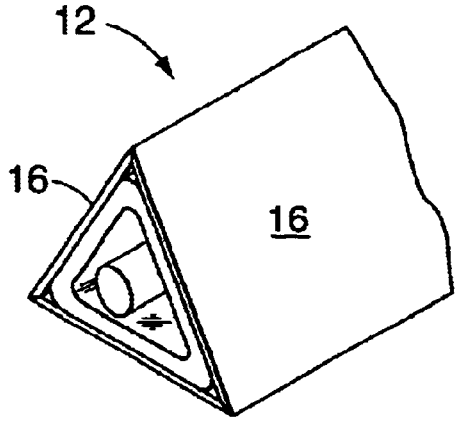
FIG. 4 is a perspective view of an end of a tri-bar element.
Figure 5:
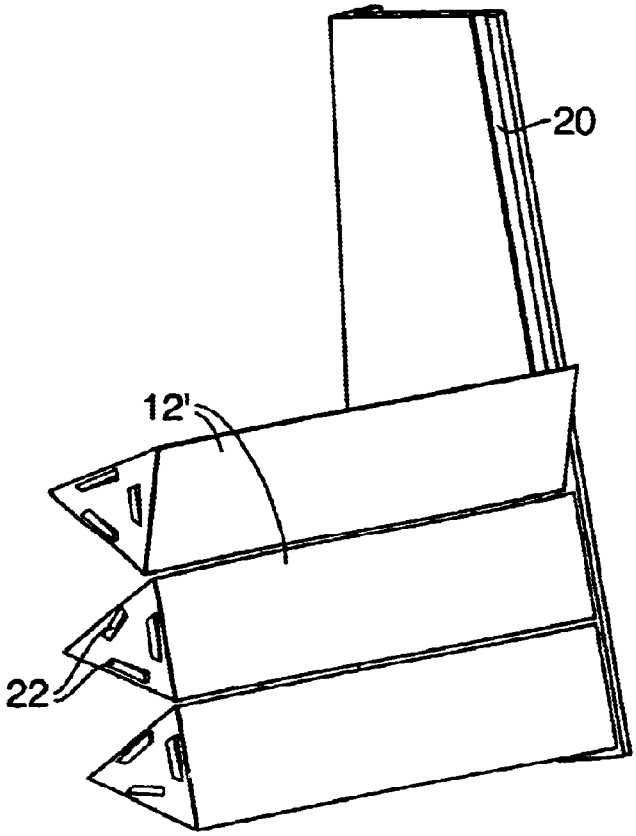
FIG. 5 is a perspective view of a manual version of a tri-bar armored platform according to the present invention.

As is illustrated in FIGS. 4 and 5, the armor system platforms can also be constructed so that the tri-bar elements 12' are manually rotated. In this embodiment, the tri-bar elements 12 are rotated by lifting the individual elements up and out of the receiving elements 20 in the hull 14. This disengages the projecting elements 22 on the ends of the tri-bar elements 12', so that the tri-bar elements 12' can be easily rotated.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

We claim:

1. A method of reducing the signature of an armored structure comprising the steps of:

a) protecting said structure with an armor hull, b) mounting a plurality of multi-sided armor bar elements adjacent to an outer surface of said armor hull, c) coating a plurality of outer surface faces of each of said bar elements with a plurality of signature reducing materials, a given signature reducing material being used to cover a corresponding one of said outer surface faces of said bar elements, and d) rotating said bar elements so that a chosen signature reducing material is on an outside position of each of said bar elements, thereby presenting said chosen signature reducing material to an observer.

2. The method of claim 1 wherein:

at least one of said signature reducing materials is a camouflage paint scheme.

3. The method of claim 1 wherein:

at least one of said signature reducing materials reduces a thermal signature.

4. The method of claim 1 wherein:

at least one of said signature reducing materials reduces a radar signature.

5. The method of claim 1 wherein:

said bar elements are rotated by a mechanized drive means.

6. The method of claim 5 wherein:

said mechanized drive means comprises a rack and a pinion, and each of said bar elements comprises a central shaft, said pinion gears being mounted on an exposed end of said shaft.

7. The method of claim 5 wherein:

a double action hydraulic cylinder provides a motive force for said rack, such that as said rack is driven up and down, said bar elements rotate to place said chosen signature reducing material at said outside position of each of said bar elements.

* * * * *